United States Patent [19]

Gunjian

[11] Patent Number: 4,819,291

[45] Date of Patent: Apr. 11, 1989

[54] CLEANING BRUSH

[75] Inventor: Armen G. Gunjian, Montreal, Canada

[73] Assignee: Brushtech, Inc., Plattsburgh, N.Y.

[21] Appl. No.: 119,729

[22] Filed: Nov. 12, 1987

[51] Int. Cl.[4] ..... A46B 3/18

[52] U.S. Cl. ..... 15/104.2; 15/144 A; 15/160; 15/206

[58] Field of Search ..... 15/104.2, 144 A, 160, 15/164, 206, 207, 162

[56] References Cited

U.S. PATENT DOCUMENTS

| | | | |
|---|---|---|---|
| 1,154,369 | 9/1915 | Browning | 15/104.2 X |
| 2,361,395 | 10/1944 | Gilligan | 15/104.2 X |
| 2,897,525 | 8/1959 | Goodwin et al. | 15/104.2 X |
| 4,108,162 | 8/1978 | Chikashige et al. | 15/206 |

*Primary Examiner*—Edward L. Roberts

*Attorney, Agent, or Firm*—Samuel Meerkreebs

[57] ABSTRACT

A cleaning brush has a handle, an elongated stem formed from a flexible coil spring, bristles at the end of the stem and a stiff member extending axially within the coil spring from the handle a distance partly the length of the stem to allow flexibility only in the area between the end of the stiff member and the bristle portion.

4 Claims, 1 Drawing Sheet

CLEANING BRUSH

BACKGROUND OF INVENTION (a) Field of the Invention

The present invention relates to a brush and more particularly to a tube cleaning brush.

(b) Description of Prior Art

Brushes for cleaning small diameter tubes are known. Such brushes generally include a handle, a stem extending from the handle, and brush bristles at the end of the stem. The stem is generally made of a pair of stiff wires twisted together offering a reasonably flexible elongated stem.

However, such a brush can maneuver bends in a small diameter tube only with difficulty and then, since the stem does not have memory, it will kink easily and not return to a true straight stem.

Gas barbecue grills present a particular problem. The gas is conducted from the control valve to the barbecue burner by way of a bent venturi tube. The tube is of small diameter, is bent and has air openings. The air openings allow dirt, bugs, spider webs and cocoons to clog the tube, thereby requiring frequent cleaning. In fact manufacturers recommend frequent cleaning, suggesting bottle brushes, coat hangers, etc. These devices do not do a proper cleaning job for obvious reasons.

SUMMARY OF INVENTION

An aim of the present invention is to provide a cleaning brush for the purpose of cleaning small diameter tubes and in particular bent tubes.

It is a main object of the present invention to provide a cleaning brush suitable for cleaning the venturi tube in a portable barbecue.

A construction in accordance with the present invention comprises a cleaning brush having a handle, an elongated stem extending from the handle and bristle means at the free end of the stem characterized in that the stem is a flexible elongated coil spring.

A cleaning brush according to a more specific embodiment of the present invention comprises an elongated rigid member fixed to the handle and extending within and concentric with the coil spring stem. The elongated rigid member extends only a partial length of the coil spring thus limiting the flexible portion of the stem to a length of the stem between the bristle portion and the end of the rigid member.

BRIEF DESCRIPTION OF DRAWINGS

Having thus generally described the nature of the invention, reference will now be made to the accompanying drawings, showing by way of illustration a preferred embodiment thereof, and in which.

DESCRIPTION OF PREFERRED EMBODIMENTS

Figure 2:
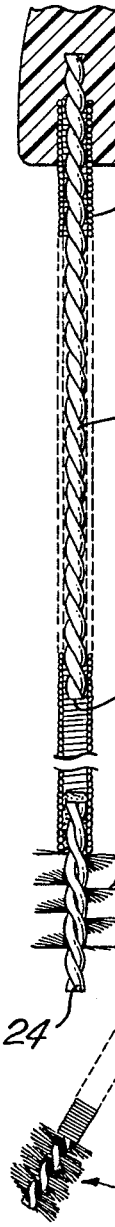
FIG. 2 is a fragmentary axial cross section of the brush of FIG. 1.
Figure 1:
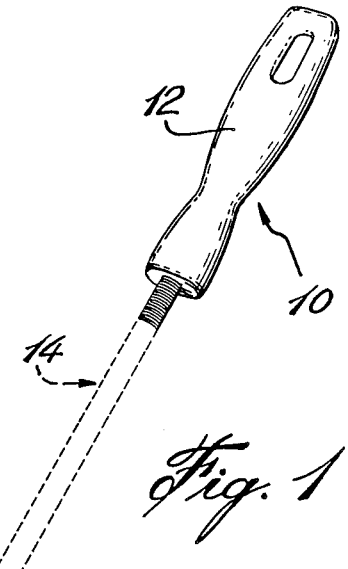
FIG. 1 is a perspective view of a cleaning brush in accordance with the present invention showing a detail thereof in dotted lines.

The cleaning brush 10 shown in FIG. 1 includes a handle 12, a stem 14 and a bristle portion 16. The handle may be of molded plastic material, wood or other material. As shown in FIG. 2, the stem 14 is made up of an elongated coil spring 18 extending from the handle 12 to the bristle portion 16.

The coil spring 18 may be a tightly wound small diameter-wire spring with considerable flexibility. In order to keep the portion of the stem close to the handle as stiff as possible, thereby giving the brush the required firmness, a rigid member 20 extends axially within the coil spring 18 concentric therewith and is fixed within the handle 12 as shown. The end 22 of the rigid member 20 is spaced from the end of the coil spring to thereby limit the flexibility of the stem 18 to the portion between the bristles 16 and the end 22 of the stiff member 20.

The stiff member 20 may be made of a twisted pair of wires as shown. In the manufacture thereof a portion of the twisted wires can be used for mounting the bristles and after the bristle portion of the twisted wires is cut off, this can be inserted at the end of the coil spring 18 as shown in FIG. 2.

In the manufacture of the cleaning brush the spring is wound with a high initial tension to give it reasonable stiffness. The spring is cut to an average length of 11 inches with an outside diameter of $\frac{1}{4}$ inch. The bristle brush portion is mounted in the conventional way at the time of twisting the wires 24. After the bristles are twisted with the wires, the bristles are trimmed to approximately $\frac{5}{8}$ inch diameter. The brush portion 16 is approximately 1 inch long and is inserted into the end of the coil spring 18. The length of the stiff brush portion 16 must be determined by the average radius of curvature of the bend in a typical venturi tube for a gas barbecue, for instance. If the stiff brush portion were longer, it would be more difficult to maneuver it through a bent portion of a small diameter tube. The brush portion, including the twisted wires and the bristles, may be fixed to the end of the coil spring by crimping or by glue. The wires are selected to be long enough such that when they are cut to form the brush portion a long residue portion is left which is then placed in the coil spring 18 forming the stiff member 20.

The stiff member 20 normally extends outwardly of the spring a short distance. If a molded plastic handle is used, the coil spring and the stiff member 20 are heated and then pressed into the end of the handle whereby it will melt the plastic and then solidify by cooling. If a wooden handle is used, then the stem may be placed therein and secured with glue.

Figure 3:
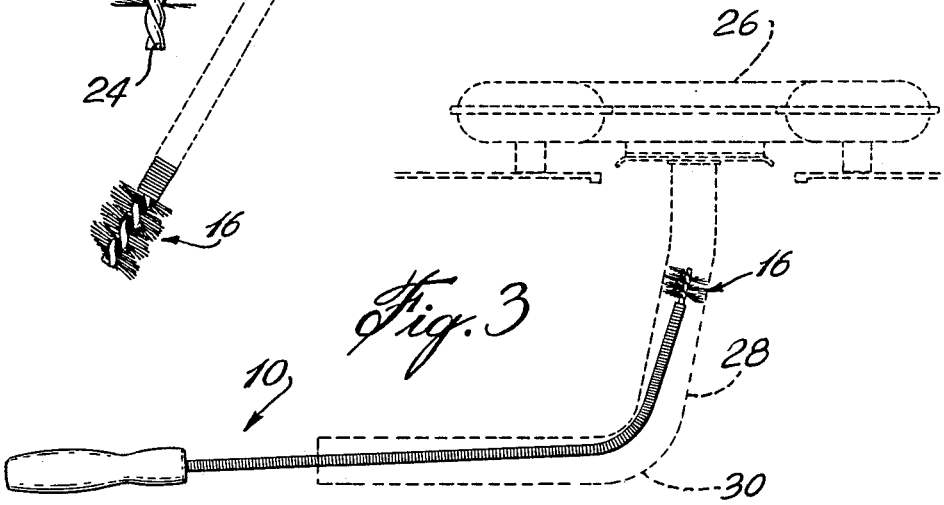
FIG. 3 is a side elevation showing the brush in operation.

FIG. 3 shows a typical barbecue burner 26 shown in dotted lines with a venturi tube 28 having a typical bend at 30. The brush 10, as can be seen, can be maneuvered such that the bristle part 16 enters the free end of the venturi tube and as the brush advances the coil spring will bend with the diameter of bend 30 of the tube 28.

I claim:

1. A cleaning brush for cleaning the internal surface of a hollow workpiece comprising a handle, an elongated stem extending from the handle , and bristle means at the free end of the stem, characterized in that the stem is a one-piece, flexible, elongated coil spring having a uniform diameter, and an elongated rigid member is fixed to the handle and is fixed concentric with and rigidifies the coil spring stem and extends within the a length less than the length of the coil spring stem to a point spaced from the bristle means at the end of the stem, said rigid member limiting the flexibility of the coil spring to only the portion between the end of the stiff member and the bristle means whereby the elongated coil spring can serve to scrape the inner surface of a hollow work piece.

2. A cleaning brush as defined in claim 1, wherein the bristle means includes a rigid stem portion in which the bristles are anchored, the length of the rigid stem portion being selected to be able to maneuver a bend in a small diameter tube to be cleaned.

3. A cleaning brush as defined in claim 2 having sizes and dimensions suitable for use in the venturi tube of a portable barbecue grille.

4. A cleaning brush as defined in claim 2, wherein the rigid stem portion in which the bristles are anchored and the elongated rigid member within the coil spring stem are separate sections of a twisted pair of wires.

* * * * *